United States Patent [19]

Maurer

[11] 4,295,661

[45] Oct. 20, 1981

[54] LATCHING MECHANISM FOR MACHINE STABILIZER ARMS USING HYDRAULIC CYLINDERS

[75] Inventor: Herman J. Maurer, Burlington, Iowa

[73] Assignee: J. I. Case Company, Racine, Wis.

[21] Appl. No.: 111,099

[22] Filed: Jan. 10, 1980

[51] Int. Cl.[3] ..... B66C 5/10

[52] U.S. Cl. ..... 280/765; 212/189

[58] Field of Search ..... 280/762, 763, 764, 765, 280/766; 212/189; 248/170, 171, 168, 169, 221.3; 24/3 J; 292/144, 201; 52/115

[56] References Cited

U.S. PATENT DOCUMENTS

| | | | |
|---|---|---|---|
| 492,911 | 3/1893 | Bohlin | 24/3 J |
| 1,709,144 | 4/1929 | Mueller | 248/221.3 |
| 1,972,434 | 9/1934 | Yerk | 24/3 J |
| 4,026,428 | 5/1977 | Shumaker | 212/189 X |
| 4,029,038 | 6/1977 | Pfahl | 248/221.3 X |
| 4,100,707 | 7/1978 | Kranefeld et al. | 52/115 |
| 4,236,643 | 12/1980 | Schmitz | 280/764 X |

*Primary Examiner*—Joseph F. Peters, Jr.
*Assistant Examiner*—Michael Mar
*Attorney, Agent, or Firm*—Dressler, Goldsmith, Shore, Sutker & Milnamow Ltd.

[57] ABSTRACT

In heavy mobile construction machinery such as backhoes, power shovels and boom cranes, wherein hydraulically actuated outriggers are extended for lateral stabilization, an automatically self-locking and self-releasing latching mechanism is provided to restrain an outrigger in its retracted inoperative position when not in use. The latching mechanism is operable in response to simple hydraulic actuation of the outrigger, and does not require manual operation or remote controls to effect locking or release of the mechanism.

6 Claims, 3 Drawing Figures

LATCHING MECHANISM FOR MACHINE STABILIZER ARMS USING HYDRAULIC CYLINDERS

TECHNICAL FIELD

This invention relates to a latching mechanism for mobile construction machinery with hydraulically operable outrigger stabilizer arms which releasably latches an arm in the retracted inoperable position when not in use.

BACKGROUND OF THE INVENTION

In industrial and construction machinery, hydraulic cylinders as frequently used to control the movement and operation of machine components. Typically, the cylinder tube end of the hydraulic cylinder is connected to the machinery frame, and the distal end of the telescoping cylinder rod is connected to the machine component. In this arrangement, when the machine component is in a non-operating mode, the cylinder rod is normally fully retracted in the cylinder tube. However, due to hydraulic fluid leakage in the valve, seals, lines, fittings or other places, the weight of the machine component, or other forces, may cause the cylinder rod to undesirably extend from the cylinder tube when the hydraulic cylinder is not actuated.

Prior art devices have attempted to latch or restrain the cylinder rod in the retracted position when a machine component attached thereto is not being operated, but such devices have either required a machine operator to leave from his machine station or seat to engage a latch or linkage to lock the cylinder rod in the retracted position, or have required separate latch or linkage parts to be attached to the frame of the overall machine.

There are several disadvantages of a device which requires a latching or linkage part to be attached to the machine frame. One disadvantage is that the latching part attached to the machine may come out of alignment with its mating part attached to the cylinder rod or cylinder tube. Another disadvantage is that the design of such a latching device requires that part of the machine frame must be located near the machine component or hydraulic cylinder being latched, in order for the latching part attached to the frame to mate with the latching part attached to the machine component or cylinder, which may require additional design considerations.

SUMMARY OF THE INVENTION

In accordance with the present invention, a latching mechanism for use with hydraulic cylinders is provided to releasably latch the cylinder rod in a retracted position. The latching mechanism comprises two abutting surfaces; one provided by the end of the cylinder rod and one associated with the cylinder tube. The abutting surface associated with the cylinder tube is a flat spring mounted to the cylinder tube, one end of which extends toward the end of the cylinder rod. The unmounted end of the spring and the distal end of the cylinder rod coact to perform a latching function.

Thus, the cylinder rod can be latched in the retracted position solely by hydraulic actuation and can be released from this latch position solely by hydraulic actuation, without the need of a machine operator to leave his work station. Also, the latching mechanism is disposed completely on the hydraulic cylinder, and obviates the need for parts of the device to be attached to a machine frame or the machine component being restrained.

BRIEF DESCRIPTION OF THE DRAWING

In the accompanying drawing.

DESCRIPTION OF THE PREFERRED EMBODIMENT

Figure 1:
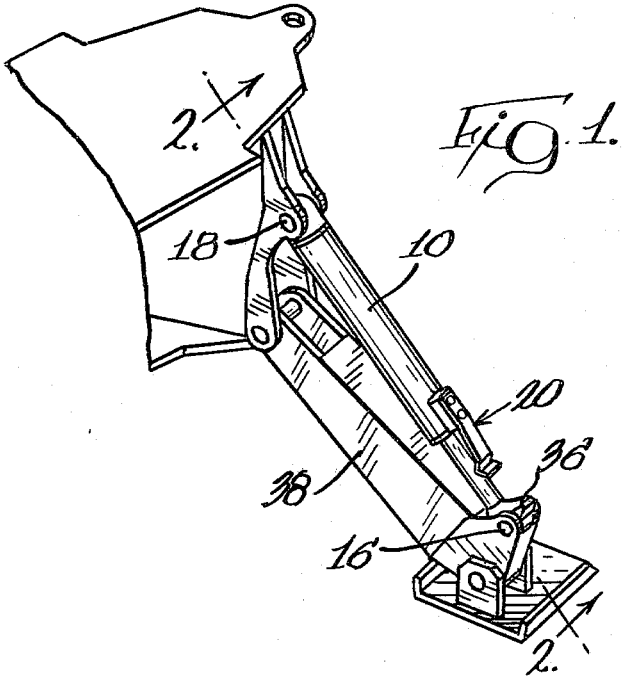
FIG. 1 is an illustration showing the hydraulic cylinder latching means of the present invention shown incorporated on the stabilizer arm of mobile machine, with the arm shown in the down, stabilizing position.

Referring to the drawing, a hydraulic cylinder tube or housing 10 is provided with a reciprocable hydraulic cylinder rod 12. The hydraulic cylinder rod 12 is hydraulically actuable to reciprocate within the cylinder housing 10 by way of controlling the flow of pressurized hydraulic fluid in the cylinder, which is well known to those skilled in the art.

At the distal end of the cylinder rod 12 is a rod eye 14 having an abutting surface which protrudes radially from the central axis of cylinder rod 12 a greater distance than the portion of the rod which reciprocates within the hydraulic cylinder housing 10. The rod eye 14 preferably defines an annular bore 16 which can receive a bolt or the like to thereby fasten a machine component to be controlled by the cylinder. The opposite distal end of the hydraulic cylinder 10 also preferably defines an annular bore 18 by which the hydraulic cylinder 10 can be mounted to the machine frame or the like.

Associated with the cylinder housing 10 which receives the cylinder rod 12 is another abutting surface comprised of a flat spring 20. Spring 20 is mounted to the cylinder housing 10 by means of two conventional machine bolts 22 which pass through two apertures 24 in the flat spring 20. Aligned with apertures 24 are two threaded bores 26 in mounting plate 28 to receive the mounting bolts 22 and fasten the end of the spring 20 rigidly to the cylinder housing 10. Apertures 24 can be elongated to provide for axial positional adjustment of spring 20 relative to cylinder housing 10. Mounting plate 28 is either welded to the exterior of the cylinder housing 10, or cylinder housing 10 can be originally cast to contain a mounting block 28.

The spring 20 is mounted so that it has a free end 32 which extends beyond the end of the cylinder housing 10. This free end 32 has a raised portion 34 which is shown to have a V-shape. The rod eye 14 has a protruding surface 36 which is shown in the preferred embodiment to have an inverted V-shape. These surfaces abut and coact to perform a latching function as will be described below.

Figure 2:
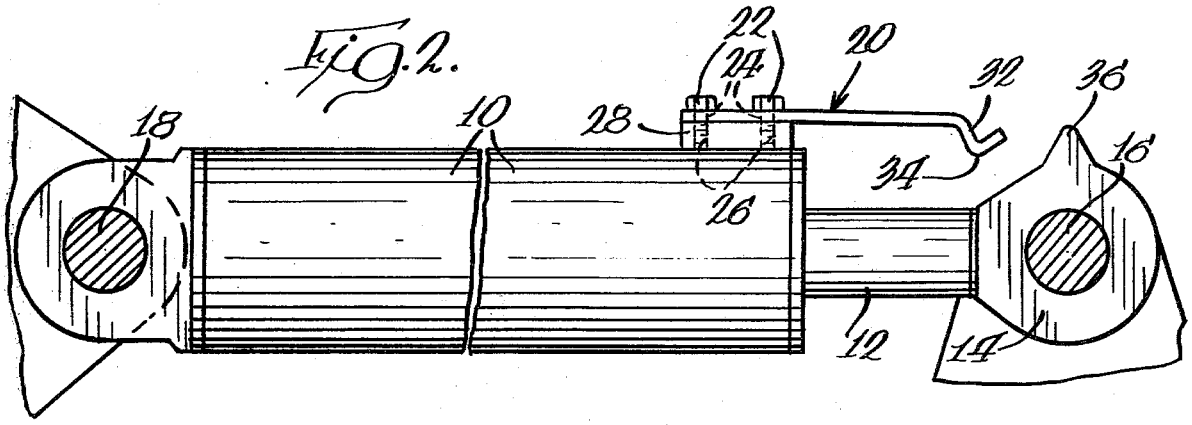
FIG. 2 is an illustration of the hydraulic cylinder and latching means of the invention, with the cylinder rod extended beyond a retracted latched position, and thus free to move.

As shown in FIG. 2, the cylinder rod 12 can reciprocate within the cylinder housing 10 as long as the cylinder rod 12 is extending from cylinder housing 10 more than a preselected retraction position as will be described below. When so extended the raised portion 34 of spring 20 is free from contact from the side of the cylinder rod 12 so as not to damage the finish of the rod, thereby possibly causing leakage in the hydraulic cylinder.

As a cylinder rod is hydraulically actuated to retract within the cylinder housing 10, the rightmost edge of raised portion 34 contacts and abuts the leftmost edge of protruding surface 36. Further retraction of the cylinder rod will result in the leftmost edge of protruding surface 36 causing the free end 32 of leaf spring 20 to bend upward. Still further retraction will result in the uppermost apex of protruding surface 36 contacting and abutting the lowermost apex of raised portion 34 and still further retraction of the cylinder rod will allow the spring end 32 to return downward so that the left surface of the V-shape protrusion 34 will engage the right surface of the V-shape raised portion 36, as shown in FIG. 2, to assume a fully latched retracted position.

Figure 3:
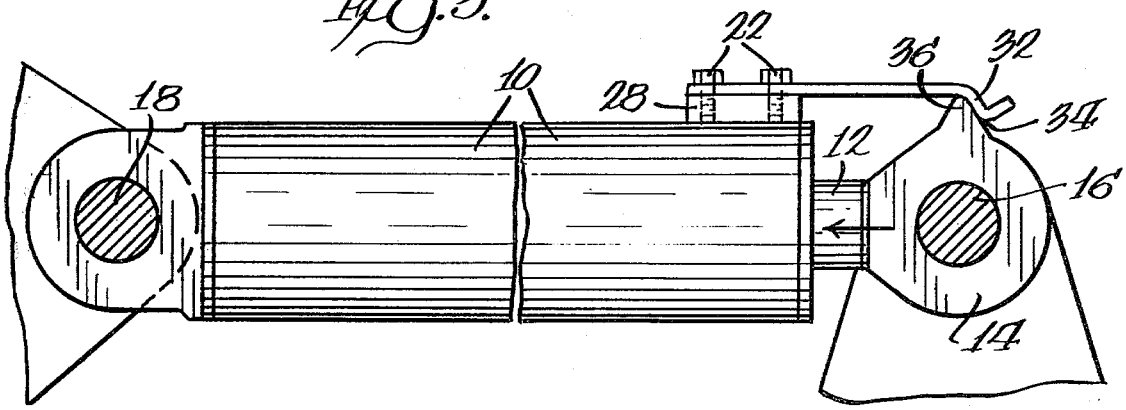
FIG. 3 is an illustration of the hydraulic cylinder and latching means, with the cylinder rod shown in the fully latched retracted position.

When the cylinder rod 12 is in this fully latched retracted position as shown in FIG. 3, the cylinder rod 12 is prevented from extension relative to the cylinder housing 10 until sufficient extension force is imparted to the cylinder rod 12 to overcome the retention force, which is caused by leaf spring 20 firmly engaging the surface of its raised portion 34 against the abutting surface of protrusion 36. This retention force is less than the maximum hydraulic extension actuation force that the hydraulic cylinder is capable of producing, but is normally sufficient to latch the extension rod 12 in the retracted position shown in FIG. 3 and overcome any forces caused by static loads upon the machine component connected to the cylinder rod 12. This latching retention force is especially necessary when the static hydraulic retention force of the hydraulic cylinder is comparatively diminished due to system leakage in the valve, seals, lines or fittings.

This retention force generated by the leaf spring 20 will thus prevent the cylinder rod 12 from extending beyond this retracted position until hydraulic actuation extension force of the cylinder overcomes this retention force and causes the hydraulic cylinder rod 12 to extend beyond this preselected retracted position. This preselected position, (the point where the cylinder rod 12 latches in relation to the cylinder housing 10) can be adjusted by varying the distance between where the spring is mounted and the raised portion 34.

The holding ability and retention force of this detent latching mechanism may be adjusted by the strength of the leaf spring 20 and the ramp angles on the inverted V-shape protrusion 36 of rod eye 14 and V-shape raised portion 34 of leaf spring 20.

Of course, the leaf spring 20 could be mounted to and associated with the rod eye 14 and the V-shaped radial protrusion 36 could be associated with the cylinder housing 10.

Further, while the rod eye 14 preferably has a V-shape detent 36, this V-shaped configuration is not a required element of the present invention. The abutting surface associated with the cylinder rod could be either a conventional rounded eye rod end, or most any other abutting surface so long as it coacts with an abutting surface associated with the cylinder housing.

Preferably, the abutting surface 34 does not come in contact with the cylinder rod 12 when the rod is in the extended position, or else the finish of the rod may become marred and possibly cause hydraulic failure. Preferably, the abutting surface associated with the cylinder rod is a protruding surface provided on eye rod 14 which extends more radially from the cylinder rod's central axis than the surface of cylinder rod 12, and the retention force generated when the abutting surfaces coact will normally latch the cylinder rod from extending beyond a retracted position until the hydraulic cylinder is actuated.

The present invention is especially suited for use with construction machinery such as backhoes, power shovels and boom cranes which have an outrigger 38 extending downwardly from their side frames to engage the ground and provide lateral stabilization against the tipping of the machine as shown in FIG. 1. These outriggers typically are hydraulically powered to anchor them against the ground when the machine is in operation, and to retract them upwardly to an inactive position when the machine is in transit or not in operation. Such an application is illustrated in FIG. 1.

If only the hydraulic system is relied upon to maintain an outrigger firmly in its inactive position, the outrigger will have a tendency to droop downwardly due to various factors, such as cooling of the system after operation, and hydraulic system leakage. Any substantial drooping of an outrigger is undesirable, particularly when a vehicle is being transported along the highways, or when transporting the machine through a relatively narrow passageway. If the stabilizer comes down while the machine is parked with no operator, it may engage and damage some other object and piece of equipment.

When the hydraulic cylinder latching device of the present invention is used in a stabilizer leg the leg will latch in the up position when the cylinder rod is sufficiently hydraulically retracted into the cylinder tube and will normally unlatch only when the operator hydraulically actuates the cylinder to overcome the force of the latching mechanism.

The operator of the machine need not dismount from his seat in order to release the latching mechanism since this can be done solely by hydraulic actuation. Also, the latching mechanism of the invention is fully incorporated on a hydraulic cylinder and does not require any part of the latching device to be incorporated on the frame of the machine or any other location other than on the hydraulic cylinder.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. In a mobile machine having at least one outrigger arm pivotally mounted thereon and movable between a lower ground-engaging position and a raised and inactive position powered by a hydraulic cylinder including a cylinder housing and a cylinder rod, said outrigger arm being adapted to provide lateral stabilization for the machine; a latching mechanism for the hydraulic cylinder releasably latching the cylinder rod in a retracted position, the latching mechanism comprising:

a generally flat spring having a generally V-shaped raised portion at one end and mounted at its other end to the cylinder housing so that the raised portion end of the spring extends beyond the end of the cylinder housing with the raised portion extending generally toward the cylinder rod without contacting the rod; and a radial protrusion at the end of the cylinder rod extending beyond the diameter of the rod such that the radial protrusion contacts and coacts with the raised portion of the spring as the cylinder rod is retracted, whereby movement of the cylinder rod from an extended position end of the spring, which is otherwise free from contacting the cylinder rod, to contact and slide completely over the protrusion at the end of the cylinder rod when the cylinder rod reaches a preselected retracted position relative to the cylinder housing, and whereby the cylinder rod is held from extension by a spring retention force less than the hydraulic actuation force of the cylinder, until an unlatching extension force larger than the spring retention force is exerted upon the cylinder rod to overcome the spring retention force and allow extension of the rod beyond the preselected retracted position.

2. The latching mechanism of claim 1 wherein the radial protrusion at the end of the cylinder rod has an inverted V-shape.

3. The latching mechanism of claim 1 including a mounting plate fixed on the cylinder housing with the spring being mounted on the mounting plate.

4. The latching mechanism of claim 3 including a bolt and wherein the mounting plate defines at least one threaded bore and the spring defines at least one aperture, the spring being mounted on the mounting plate by threading the bolt through the aperture and into the bore.

5. The latching means of claim 4 wherein the aperture is elongated to provide for axial positional adjustment of the spring relative to the cylinder housing.

6. A latching mechanism for a hydraulic cylinder having a cylinder rod which releasably latches the cylinder rod in a retracted position, comprising:

a spring having a V-shaped raised portion at one end and mounted at its other end to the cylinder housing so that the raised portion end of the spring extends beyond the end of the cylinder housing with the raised portion extending generally toward the cylinder rod without contacting the rod; and an inverted V-shaped radial protrusion at the end of the cylinder rod extending beyond the diameter of the rod, whereby movement of the cylinder rod from an extended position to a retracted position causes the raised portion end of the spring, which is otherwise free from engaging the cylinder rod, to contact and slide completely over the inverted V-shaped protrusion at the end of the cylinder rod when the cylinder rod reaches a preselected retracted position relative to the cylinder housing, and whereby the cylinder rod is held from extension by a spring retention force less than the hydraulic actuation force of the cylinder, until an unlatching extension force larger than the spring retention force is exerted upon the cylinder rod to overcome the spring retention force and allow extention of the rod beyond the preselected retracted position.

* * * * *